US006911421B2

(12) United States Patent
Ikebata

(10) Patent No.: US 6,911,421 B2
(45) Date of Patent: Jun. 28, 2005

(54) SURFACTANT BLENDS FOR REMOVING OLIGOMER DEPOSITS FROM POLYESTER FIBERS AND POLYESTER PROCESSING EQUIPMENT

(75) Inventor: Kazu Ikebata, Mauldin, SC (US)

(73) Assignee: NICCA USA, Inc., Fountain Inn, SC (US)

( * ) Notice: Subject to any disclaimer, the term of this patent is extended or adjusted under 35 U.S.C. 154(b) by 420 days.

(21) Appl. No.: 10/286,437

(22) Filed: Nov. 1, 2002

(65) Prior Publication Data

US 2004/0087458 A1 May 6, 2004

(51) Int. Cl.[7] ..... C11D 1/72; C11D 1/825

(52) U.S. Cl. ..... 510/188; 8/137.5; 134/2; 510/200; 510/219; 510/234; 510/289; 510/421

(58) Field of Search ..... 8/137.5; 134/2; 510/188, 200, 219, 234, 289, 421

(56) References Cited

U.S. PATENT DOCUMENTS 3,679,349 A 7/1972 von der Eltz et al.
3,752,649 A 8/1973 Smerz et al.
4,155,856 A * 5/1979 Reinert et al. ..... 8/137.5
4,234,311 A 11/1980 Schuierer
4,247,342 A * 1/1981 Kuhn ..... 134/2
4,294,576 A * 10/1981 Helfert et al. ..... 8/137.5
6,004,357 A 12/1999 Dohmen
6,184,010 B1 2/2001 Riegels et al.

FOREIGN PATENT DOCUMENTS

GB 1323994 7/1973
JP 08113873 5/1996

OTHER PUBLICATIONS

NICCA Chemical Co., Ltd., Technical Brochure for Eskudo NEO–3, Nov. 15, 2000.

* cited by examiner

*Primary Examiner*—Charles Boyer
(74) *Attorney, Agent, or Firm*—Alston & Bird LLP; Andrew T. Meunier

(57) ABSTRACT

The present invention is a composition comprising a surfactant blend of nonionic and anionic surfactants useful for the removal of oligomer deposits from polyester fibers and polyester processing equipment. The composition of the present invention includes a surfactant blend of an ethoxylated sorbitan ester and at least one additional nonionic or anionic surfactant. The combination of the ethoxylated sorbitan ester and additional surfactants used in the invention surprisingly has a synergistic effect on the removal of oligomer deposits from polyester fibers and polyester processing equipment.

10 Claims, 1 Drawing Sheet

SURFACTANT BLENDS FOR REMOVING OLIGOMER DEPOSITS FROM POLYESTER FIBERS AND POLYESTER PROCESSING EQUIPMENT

FIELD OF THE INVENTION

The present invention relates to surfactant blend compositions of both nonionic and anionic surfactants useful for the removal of oligomer deposits from polyester fibers and polyester processing equipment, and methods of using such surfactant blend compositions.

BACKGROUND OF THE INVENTION

Poly(ethylene terephthalate) (PET) fibers are the primary type of polyester fibers produced by the textile industry. PET is synthesized by condensation, drawn into fibers from a melt, and can be cut into staple, or spun into yarn. The polyester can be dyed and knitted into cloth or made into carpets, or the polyester can be woven into fabric and dyed. The polyester can also be blended with natural fibers or other types of synthetic fibers to form polyester blends for use in these applications.

A common problem in the polyester industry is the formation of oligomer deposits during the production of polyester and various polyester textile products. These oligomers are formed as a by-product in the synthesis of polyethylene terephthalate and become deposited both on and in the polyester fibers. In particular, the amount of these oligomers in the polyester material can be up to 5% by weight. The presence of these oligomers on or in the polyester fibers can result in an undesirable grayish appearance of the final fabric. Furthermore, when the polyester is dyed, particularly with the disperse dyestuffs generally used for the dyeing of polyester fibers, fair non-dyed spots may remain on the dyed goods because of these oligomers. Moreover, the spinning of dyed polyester fibers that contain oligomers results in the formation of considerable amounts of dust, which causes further production problems. Additionally, oligomer deposits may impair the physical properties of the textile material such as for example the running properties and the feel of the textile material.

In addition to forming on and in the fibers, these oligomers can also become deposited on machinery. Specifically, oligomer deposits are transported throughout the production equipment and have a tendency to deposit on the stainless steel equipment in which the dyeings are conducted. As a result, the equipment requires frequent scouring under highly alkaline conditions to remove the material from the surface. In addition, solvents such as trichlorobenzene may also have to be incorporated into the cleaning solution. These processes require high temperatures and long treatment times, and are complicated to carry out. Very often, oligomer deposits are also found in the liquor pumps of the dyeing machines resulting in interruptions in production.

Those skilled in the art have therefore tried to remove oligomers from polyester by means of various after-treatment methods. For example, it is known that oligomers may partly be eliminated by rinsing the polyester with hot water or by subjecting the polyester to an alkaline reductive after-treatment in the presence of a tenside, for example a fatty acid polyglycol ester, at elevated temperatures. However, cyclic oligomers may be difficult to remove and resistant to such an alkaline post treatment. Therefore, to be effective, alkaline treatment must be severe, which results in a significant loss of polyester fiber material. Organic solvents have also been used to try to remove oligomers from polyester but it is difficult to find one that is compatible with and noninjurious to the textile material. Chlorinated hydrocarbons, fluorinated hydrocarbons and hydrocarbons themselves have also been used in the art to remove oligomer deposits.

All of the before-mentioned treatments used in the art pose production problems along with time and cost issues. Accordingly, there is a need in the art for removing oligomer deposits that results in minimal interruptions in production and poses little threat to the quality of the polyester or polyester textile product.

SUMMARY OF THE INVENTION

The present invention is a surfactant blend that effectively removes oligomer deposits from polyester fiber and polyester processing equipment. As a result, the surfactant blend of the invention when used to treat polyester fiber results in better fiber dyeing. In addition, the surfactant blend of the invention when applied to polyester processing equipment reduces the frequency that the equipment (e.g. dyeing machinery) must be shut down to be cleaned. The surfactant blend of the present invention can be used at various stages in polyester production and processing for the removal of oligomer deposits.

The surfactant blend compositions of the present invention include at least one ethoxylated sorbitan ester and at least one additional compound selected from the group consisting of ethoxylated tristyryl phenols, ethoxylated nonyl phenol condensates, anionic ethoxylated pentaerythritols and esters thereof, anionic ethoxylated glycols and esters thereof, anionic salts of ethoxylated tristyryl phenols and esters thereof, anionic salts of nonyl phenol condensates and esters thereof, polyethylene glycol esters, and ethoxylated castor oil esters. Preferably, the composition comprises an ethoxylated sorbitan ester and at least one first compound selected from the group consisting of ethoxylated tristyryl phenols and ethoxylated nonyl phenol condensates, at least one second compound selected from the group consisting of anionic ethoxylated pentaerythritols and esters thereof and anionic ethoxylated glycols and esters thereof, and at least one third compound selected from the group consisting of anionic salts of ethoxylated tristyryl phenol and esters thereof and anionic salts of nonyl phenol condensates and esters thereof. More preferably, the composition includes an ethoxylated sorbitan ester, an ethoxylated tristyryl phenol, an anionic ethoxylated pentaerythritol or ester thereof, and an anionic salt of an ethoxylated tristyryl phenol or ester thereof. Most preferably, the composition includes sorbitan trioleate; ethoxylated tristyryl phenol; oleated, sulfated and ethoxylated pentaerythritol; and an ammonium salt of ethoxylated sulfated tristyryl phenol. The composition optionally includes lubricating surfactants such as polyethylene glycol esters and ethoxylated castor oil esters.

The present invention also includes a method for removing oligomer deposits from polyester and polyester processing equipment, comprising contacting polyester fibers or polyester processing equipment with a composition comprising an ethoxylated sorbitan ester and at least one additional compound selected from the group consisting of ethoxylated tristyryl phenols, ethoxylated nonyl phenol condensates, anionic ethoxylated pentaerythritols and esters thereof, anionic ethoxylated glycols and esters thereof, anionic salts of ethoxylated tristyryl phenols and esters thereof, anionic salts of nonyl phenol condensates and esters thereof, polyethylene glycol esters, and ethoxylated castor oil esters. Preferably, the composition comprises an ethoxylated sorbitan trioleate, an ethoxylated tristyryl phenol, an oleated, sulfated and ethoxylated pentaerythritol, and an ammonium salt of an ethoxylated sulfated tristyryl phenol. The composition may be utilized at various times during the processing of the polyester. Preferably, the composition is utilized during the scouring stage, dyeing stage, or reduction clear stage. The composition can also be used for machine cleaning when the polyester processing equipment is down. The compositions and methods of the present invention are useful in the production of polyester fibers, yarns, fabrics and garments, including the production of polyester blends.

These and other features and advantages of the present invention will become more readily apparent to those skilled in the art upon consideration of the following detailed description and accompanying drawings, which describe both the preferred and alternative embodiments of the present invention.

DETAILED DESCRIPTION OF THE PREFERRED EMBODIMENTS

Figure 1:
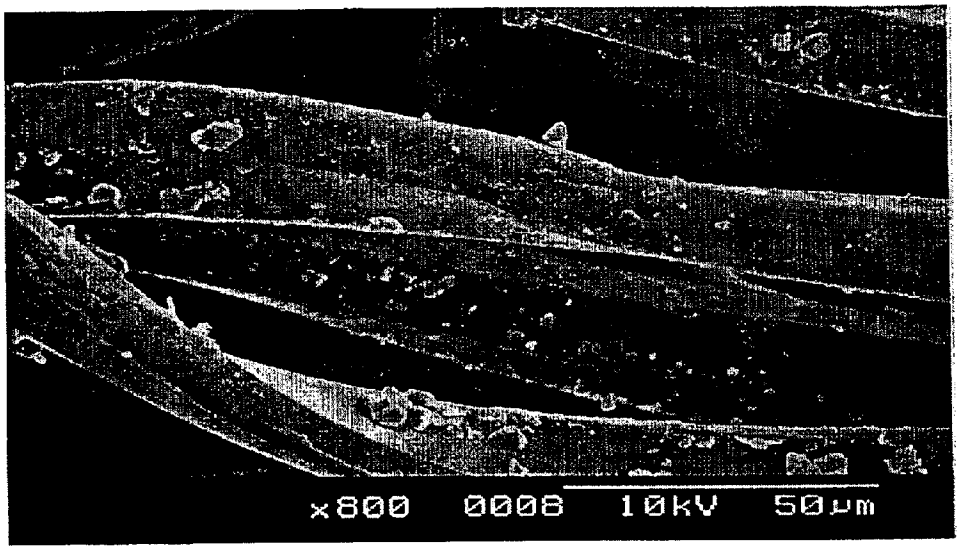
FIG. 1 is a Scanning Electronic Microscope (SEM) photograph of untreated polyester fibers.

In the drawings and the following detailed description, preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description and accompanying drawings. The term "comprising" as used herein is used synonymously with the term "including" and is an open, non-limiting term.

The term "polyester fibers" as used herein is intended to include not only polyester fibers and filaments but also any textile product that include polyester fibers including yarns, fabrics, garments, carpets, rope, tow and the like. In addition, this term includes textile products that include blends of polyester fibers and other fibers. For example, the polyester fibers may include a blend of polyester fibers and one or more additional types of synthetic or natural fibers. These additional types of fibers may include, but are not limited to cotton, rayon, nylon, lycra, wool, polylactic acid and polybutylene terephthalate. Further, although various textile articles and processes are mentioned herein, the present invention is useful in reducing oligomer deposits from polyester or polyester processing equipment beyond those contemplated in the textile industry.

The present invention is a composition and method of using a surfactant blend to remove oligomers from polyester fiber or polyester processing equipment. The oligomers are low molecular weight forms of polyester and can exist in various forms. For example, the oligomers may exist as cyclic or triangle type oligomers, or as linear oligomers. Accordingly, the term "oligomer" or "oligomers" as used herein is meant to encompass both cyclic and linear oligomers.

Cyclic oligomers (or trimers) may be contained in polyester chip prior to extrusion. In addition, high temperature dyeing and heat setting can generate cyclic oligomers on the fiber surface. Processed and fast extrusion polyester yarn tends to generate cyclic oligomers. Cyclic oligomers may stay on the fibers or be partly deposited on equipment and are almost insoluble, other than in an organic solvent.

Linear oligomers may also be contained within polyester chip prior to extrusion. In addition, high temperature dyeing and heat setting may also generate linear oligomers on the polyester fiber surfaces. Additionally, the alkali weight reduction treatment often used with polyester may result in hydrolysis, thus generating linear oligomers.

The surfactant blend of the present invention includes at least one ethoxylated sorbitan ester and at least one additional nonionic or anionic surfactant. The ethoxylated sorbitan ester is a nonionic surfactant and may be an oleate, stearate, ricinoleate or palmitate ester, and is preferably an oleate, such as a monooleate, dioleate, or trioleate. More preferably, the ethoxylated sorbitan ester is a trioleate. The ethoxylated sorbitan ester can have various levels of ethoxylation and preferably includes between 5 and 50 moles of ethylene oxide per molecule. The ethoxylated sorbitan ester is present in an amount from about 5% to about 50% by weight, preferably from about 10% to about 30% by weight, most preferably about 20% by weight in the composition. A particularly suitable ethoxylated sorbitan trioleate ester for use in the invention is ETHSORBOX® TO-20, which includes 20 moles of ethylene oxide, and is commercially available from Ethox Chemical LLC.

The surfactant blend of the invention preferably includes a nonionic surfactant selected from the group of ethoxylated phenols and phenol condensates, such as ethoxylated tristyryl phenols or ethoxylated nonyl phenol condensates. More preferably, the nonionic surfactant is an ethoxylated tristyryl phenol and the composition is essentially free of nonyl phenols as is desired in the art. The ethoxylated tristyryl phenols or ethoxylated nonyl phenol condensates can include various levels of ethoxylation and preferably includes between 1 and 25 moles of ethylene oxide per molecule. The ethoxylated tristyryl phenols or ethoxylated nonyl phenol condensates can be present in an amount from 0% to about 25% by weight, preferably about 2% to about 15% by weight, and most preferably about 8% by weight in the composition. A particularly suitable ethoxylated tristyryl phenol for use in the invention is SOPROPHOR® CY/8, which includes 8 moles of ethylene oxide, and is commercially available from Rhodia Inc.

The surfactant blend of the invention typically includes at least one anionic surfactant and preferably the anionic surfactants are selected from the group of anionic ethoxylated pentaerythritols and esters thereof, anionic ethoxylated glycols and esters thereof, anionic salts of ethoxylated tristyryl phenols and esters thereof, and anionic salts of nonyl phenol condensates and esters thereof. Preferably, the anionic surfactants include a first anionic surfactant selected from the group consisting of anionic ethoxylated pentaerythritols and esters thereof and anionic ethoxylated glycols and esters thereof. In addition, the anionic surfactants preferably include a second anionic surfactant selected from the group consisting of anionic salts of ethoxylated tristyryl phenols and esters thereof and anionic salts of nonyl phenol condensates and esters thereof.

As mentioned above, the first anionic surfactant is an anionic ethoxylated pentaerythritol or ester thereof or an anionic ethoxylated glycol or ester thereof. The esters are preferably oleates, stearates, ricinoleates or palmitates. The anionic groups can be, for example, sulfates, phosphonates and sulfonates and are preferably sulfates. The first surfactant can include various levels of ethoxylation and preferably includes between 1 and 25 moles of ethylene oxide per molecule. The first surfactant is preferably an oleated, sulfated and ethoxylated pentaerythritol. The first surfactant can be present in an amount from 0% to about 25% by weight, preferably about 2% to about 15% by weight, most preferably about 10% by weight in the composition. A particularly suitable surfactant for use as the first surfactant is PM-11BT, an oleated, sulfated and ethoxylated pentaerythritol that includes 11 moles of ethylene oxide and is commercially available from NICCA Chemical Co. Ltd.

The second anionic surfactant is an anionic salt of an ethoxylated tristyryl phenol or ester thereof or an anionic salt of a nonyl phenol condensate or ester thereof. The esters are preferably oleates, stearates, ricinoleates or palmitates. The anionic groups can be, for example, sulfates, phosphonates and sulfonates and are preferably sulfates. The salts are preferably ammonium, sodium or potassium salts and are more preferably ammonium salts. The second surfactant can include various levels of ethoxylation and preferably includes between 1 and 25 moles of ethylene oxide per molecule. The second surfactant preferably includes an anionic salt of an ethoxylated tristyryl phenol and the composition is preferably essentially free of nonyl phenols as is desired in the art. More preferably, the second surfactant is an ammonium salt of an ethoxylated, sulfated tristyryl phenol. The second surfactant can be present in an amount from 0% to about 10% by weight, preferably about 0.5% to about 5% by weight, most preferably about 2.1% by weight in the composition. A particularly suitable surfactant for use as the second surfactant is SOPROPHOR® 4D384, an ammonium salt of an ethoxylated, sulfated tristyryl phenol that includes 16 moles of ethylene oxide and is commercially available from Rhodia Inc.

Various lubricating surfactants may also be included in the present invention. Exemplary lubricating surfactants include polyethylene glycol esters and ethoxylated castor oil and esters thereof. The polyethylene glycol esters typically include polyethylene glycol dioleates, polyethylene glycol monooleates and the like, but in addition to oleates can also be stearates, ricinoleates and palmitates. Preferably, the polyethylene glycol esters have a molecular weight between about 400 and about 1000. The ethoxylated castor oil and esters thereof is typically an oleate, stearate, ricinoleate or palmitate and is typically an ethoxylated castor oil oleate. The lubricating surfactant can include various levels of ethoxylation and preferably includes between 1 and 50 moles of ethylene oxide per molecule. The lubricating surfactants are present in an amount from 0% to about 30% by weight, preferably about 0.5% to about 5% by weight in the composition.

Preferably, the surfactant blend of the present invention includes an ethoxylated sorbitan ester, an ethoxylated phenol or phenol condensate, a first anionic surfactant as discussed above and a second anionic surfactant as discussed above. The inventors have advantageously found that when all four components are present in the composition, the four components surprisingly have a synergistic effect and maximize oligomer removal.

The composition comprising the surfactant blend includes water in an amount from about 20 to about 90% by weight, more preferably about 25 to about 60% by weight and can also include other components such as additional surfactants (including various fatty acids), coupling agents (e.g. hexylene glycol), sequestering agents (e.g. EDTA), and the like, preferably in an total amount from 0% to about 25%. A particularly suitable fatty acid for use in the invention is EMERY® 625, a coconut fatty acid, which is commercially available from Cognis Canada Corp. Another particularly suitable fatty acid, which may be used alone or together with EMERY® 625 is INDUSTRENE® 223, another coconut fatty acid, and is commercially available from Chemtec Chemical Co. A particularly suitable sequestering agent for use in the invention is DISSOLVINE® NA4X, commercially available through Brenntag.

The present invention also provides a method for removing oligomer deposits from polyester fibers or polyester processing equipment. The surfactant blends of the present invention can be introduced at various stages of polyester processing to remove oligomer deposits on and in the polyester fibers. The surfactant blends contact the polyester fibers to disperse the oligomers in the surfactant blend composition and thus remove it from the polyester fiber. For example, the surfactant blend of the present invention may be utilized before dyeing at the scouring stage or during the dyeing stage as an additive to the dye bath. Additionally, the surfactant blend may be used during the reduction clear stage after dyeing. The surfactant blend of the present invention can be used with the high temperature processes typically employed with polyester dyeing including the use of alkaline or acidic baths and the use of dispersed dyes. In addition to applying the surfactant blend to polyester fiber, the surfactant blend may be applied to the machinery directly as a machine cleaner to remove oligomer deposits from the machinery.

As mentioned above, although not wishing to be bound by any particular theory, it is believed that the surfactant blend of the present invention disperses the oligomer present in the polyester so it can be removed from the polyester to improve dyeing and to reduce accumulation of oligomer on processing equipment. The nonionic surfactants are film-forming and it is believed that they assist with the dyeing process and diffuse into the fibers to remove the oligomer. It is also believed that the anionic surfactants act as emulsifiers and aid in the dispersion of the oligomers in the treatment composition.

The present invention will now be further described by the following non-limiting examples.

EXAMPLE 1

Figure 2:
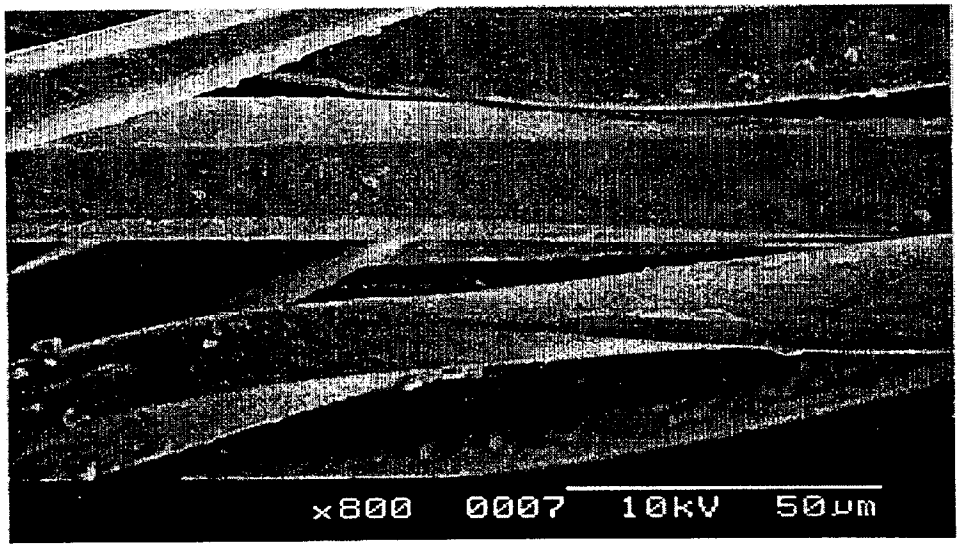
FIG. 2 is a SEM photograph of polyester fibers treated with one embodiment of the present invention.

A sample of 100% polyester fiber was produced and processed into yarn. The yarn was treated with a disperse dye and 3.0% of a surfactant blend comprising 20.0% ethoxylated sorbitan ester, 8.0% ethoxylated tristyryl phenol, 10.0% ethoxylated oleated sulfated pentaerythritol, 2.1% ethoxylated sulfated tristyryl phenol, 3.0% EMERY® 625/INDUSTRENE® 223, 16.5% hexylene glycol, 40.3% water and 0.1% DISSOLVINE® NA4X. A control yarn of 100% polyester was processed and treated with a disperse dye, but was not treated with the surfactant blend composition. Both yarns were treated with the dye at 266° F. (130° C.) for 30 minutes and then subjected to normal post-dyeing processing. Both yarns were then observed with a Scanning Electronic Microscope (SEM) to view the oligomer deposits on the fibers. The results are shown in FIGS. 1 and 2. FIG. 1 shows the oligomer deposits within the untreated yarn. FIG. 2 shows the oligomer deposit within the yarn treated with the surfactant blend of the present invention and demonstrates the effectiveness of the composition of the invention in removing oligomer deposits.

As shown above, there are many advantages associated with the composition and method of the present invention.

For example, the present invention can be advantageously used at various stages in polyester production and processing for the removal of oligomer deposits. Another advantage presented is that the surfactant blend of the present invention removes oligomer deposits from polyester fiber and polyester processing equipment. As a result, the surfactant blend of the invention results in better fiber dyeing and minimizes the deposition of oligomers on the equipment. Additionally, the present invention reduces the frequency of equipment cleaning, thereby reducing the number of times the equipment must be shut down.

It is understood that upon reading the above description of the present invention and reviewing the accompanying drawings, one skilled in the art could make changes and variations therefrom. These changes and variations are included in the spirit and scope of the following appended claims.

What is claimed is:

1. A method of removing oligomer deposits from polyester fibers during processing and polyester processing equipment comprising:

contacting polyester fibers during processing or polyester processing equipment with a composition comprising an ethoxylated sorbitan ester and at least one additional compound selected from the group consisting of ethoxylated tristyryl phenols, ethoxylated nonyl phenol condensates, anionic ethoxylated pentaerythritols and esters thereof, anionic ethoxylated glycols and esters thereof, anionic salts of ethoxylated tristyryl phenols and esters thereof, anionic salts of nonyl phenol condensates and esters thereof, polyethylene glycol esters, and ethoxylated castor oil esters.

2. The method of claim 1, wherein said contacting step comprising contacting polyester processing equipment with said composition in a machine cleaning step.

3. The method of claim 1, wherein said contacting step comprises contacting polyester fibers with the composition during scouring of the polyester fiber prior to dyeing.

4. The method of claim 1, wherein said contacting step comprises contacting the polyester fibers with the composition during dyeing of the polyester.

5. The method of claim 1, wherein said contacting step comprises contacting the polyester fibers with said composition during a reduction clear stage after dyeing said fibers.

6. The method of claim 1, wherein the composition comprises an ethoxylated sorbitan trioleate, an ethoxylated tristyryl phenol, an oleated, sulfated and ethoxylated pentaerythritol, and an animonium salt of an ethoxylated sulfated tristyryl phenol.

7. The method of claim 1, wherein the contacting step comprises contacting polyester fibers with the composition wherein the polyester fibers are present in a textile article selected from the group consisting of yarns, tow, fabrics, and garments.

8. The method of claim 1, wherein the contacting step comprises contacting a blend of polyester fibers and one or more additional types of fibers with the composition.

9. The method of claim 1, wherein the contacting step comprises contacting a blend of polyester fibers and one or more additional types of synthetic and natural fibers selected from the group consisting of cotton, rayon, nylon, lycra, wool, polylactic acid, and polybutylene terephthalate, with the composition.

10. The method of claim 8, wherein the contacting step comprises contacting a blend of polyester fibers and one or more additional types of fibers with the composition, wherein the blend is in the form of a textile article selected from the group consisting of yarns, tow, fabrics, and garments.

* * * * *